US011819132B2

(12) United States Patent
Kropfelder et al.

(10) Patent No.: US 11,819,132 B2
(45) Date of Patent: Nov. 21, 2023

(54) FOLDABLE TOILET FOOTREST

(71) Applicant: SQUATTY POTTY USA, LLC, New York, NY (US)

(72) Inventors: Bernard R. Kropfelder, St. George, UT (US); Phillip Dietz, St. George, UT (US)

(73) Assignee: SQUATTY POTTY USA, LLC, New York, NY (US)

( * ) Notice: Subject to any disclaimer, the term of this patent is extended or adjusted under 35 U.S.C. 154(b) by 0 days.

(21) Appl. No.: 17/659,300

(22) Filed: Apr. 14, 2022

(65) Prior Publication Data

US 2022/0369821 A1 Nov. 24, 2022

Related U.S. Application Data

(60) Provisional application No. 63/174,648, filed on Apr. 14, 2021.

(51) Int. Cl.
*A47C 16/02* (2006.01)
*A47K 17/02* (2006.01)

(52) U.S. Cl.
CPC ..... *A47C 16/02* (2013.01); *A47K 17/028* (2013.01)

(58) Field of Classification Search
CPC ..... A47C 16/02; A47C 4/10; A47B 23/001; E04G 1/34; A47K 17/028
USPC ..... 297/423.41
See application file for complete search history.

(56) References Cited

U.S. PATENT DOCUMENTS

| | | | | | |
|---|---|---|---|---|---|
| 4,462,636 | A * | 7/1984 | Markson | A47C 16/02 | 108/131 |
| 4,926,758 | A * | 5/1990 | Lilly | A63H 33/04 | 108/115 |
| 5,244,255 | A * | 9/1993 | Mill | A47C 16/02 | 248/222.52 |
| 6,966,404 | B2 * | 11/2005 | Meeker | A47C 13/00 | 108/132 |
| 8,465,100 | B2 * | 6/2013 | Kim | A47C 16/025 | 297/423.41 |
| D979,961 | S * | 3/2023 | Chen | D6/353 | |
| D986,609 | S | 5/2023 | Chu | | |
| 2010/0187041 | A1 * | 7/2010 | Crouch | A47D 15/003 | 182/223 |
| 2013/0048428 | A1 * | 2/2013 | Chancler | A47C 4/10 | 182/155 |
| 2015/0272410 | A1 * | 10/2015 | Lavassani | A47K 17/028 | 4/254 |

FOREIGN PATENT DOCUMENTS

CN 213309440 U 6/2021

* cited by examiner

*Primary Examiner* — Sarah B McPartlin
(74) *Attorney, Agent, or Firm* — Gottlieb, Rackman & Resiman, PC

(57) ABSTRACT

A foldable toilet footrest that includes a platform with a first leg and a second leg coupled thereto by hinges. The hinges can include a releasable locking system that allows the first leg and the second leg by to be fixed in an unfolded, use position or a folded, non-use position.

10 Claims, 15 Drawing Sheets

FOLDABLE TOILET FOOTREST

CROSS-REFERENCE TO RELATED APPLICATION

This patent application claims benefit to U.S. Provisional Patent Application No. 63/174,648, filed Apr. 14, 2021, which is hereby incorporated by reference in its entirety as part of the present disclosure.

FIELD OF THE INVENTION

The present disclosure relates to a footrest, and more specifically to a foldable footrest for use in conjunction with a toilet.

BACKGROUND OF THE INVENTION

Humans can perform defecation in different postures with the two most common postures being squatting and sitting positions. The squatting posture is usually used when using a squat toilet (mainly a feature of the developing world), or when toilets are unavailable. The sitting posture during defecation, which is a standard posture found in most developed countries, requires a sitting position with the back erect and the knees away from the chest in about a ninety-degree angle.

The anorectal angle, which is the angle formed in the colon where the puborectalis muscle wraps around the rectum, is a very important factor in maintaining continence. The sitting posture common to western-style toilets causes a narrowing of the anorectal angle and prevents the puborectalis muscle from relaxing, which may cause difficulty in emptying the bowels.

Additionally, the sitting position may cause the person to repeat the Valsalva maneuver, i.e., exhalation against a closed airway to increase internal pressure, holding his breath to increase internal pressure, which can lead to syncope. A sitting posture may increase issues related to weakness in the colon wall because of the increased straining needed to defecate.

In contrast, the squatting defecation posture involves squatting by standing with the knees and hips sharply bent and the buttocks suspended near the ground. By using the squatting defecation posture, the anorectal angle is increased, which allows the puborectalis muscle to fully relax, which aids defecation by reducing the amount of effort needed to empty the bowels.

The advantages of the squatting position may be obtained when using western-style toilets (i.e., where the bowl is raised from the ground and is intended for sitting as opposed to squatting) in conjunction with a footrest. Footrests help raise the knees toward the chest and help to lessen the normal sitting angle of about ninety-degrees to much less. As the feet are raised, the puborectalis muscle relaxes, the colon aligns allowing gravity to aid evacuation, and the required expulsive effort lessens. As such, several footrests exist in the art that are aimed at allowing a human to achieve a better anorectal angle while sitting on a toilet.

However, many known footrests stools and the like are one-piece and/or non-adjustable units that are often bulky and cannot be easily stored or transported. For example, when a one-piece and/or non-adjustable footrest is not in use, most individual's leave the footrest near a toilet, which takes up space and in turn may cause difficulty walking around the bathroom. Additionally, the appearance of a footrest in a bathroom when not in use can be undesirable.

Furthermore, in instances where individuals may desire to take their toilet footrest with them while traveling, which can be challenging due to the awkward, bulky size of most one-piece units and/or non-adjustable footrests.

While foldable footrests, stools and the like exist, many can be difficult to unfold to a use position and/or fold to a stored position. Additionally, many existing foldable footrests, stools and the like may not stay fixed in an unfolded or a folded position, when desired. Further, many foldable footrests, stools and the like fail to fold to a sufficiently low-profile making storage of such footrest challenging and/or unaesthetically pleasing.

SUMMARY OF THE INVENTION

Broadly, the present disclosure generally relates to a foldable toilet footrest that includes a platform with a first leg and a second leg coupled thereto by hinges. The hinges can include a releasable locking system that allows the first leg and the second leg by to be fixed in an unfolded, use position or a folded, non-use position.

In an embodiment, the present disclosure is directed to a foldable footrest that comprises a platform, a first leg, a second leg, a first hinge fixed to the platform and the first leg to hingedly couple the first leg and platform to each other and allow for rotation of the first leg with respect to the platform between a fixed extended position and a fixed collapsed position and a second hinge fixed to the platform and the second leg to hingedly couple the second leg and platform to each other and allow for rotation of the second leg with respect to the platform between a fixed extended position and a fixed collapsed position.

The first leg and the second leg each can include a first projection and a second projection that is spaced from the first projection that extend from a first end of each of the first leg and the second leg. The platform can include a first projection extending from a first end thereof and a second projection extending from a second end thereof. In an assembled state, the first projection of the platform extends between the first projection and the second projection of the first leg and the second projection of the platform extends between the first projection and the second projection of the second leg.

The hinge can include a first body portion and a second body portion that are pivotably fixed to each other. The first body portion can include a first flange through which a first opening and a second opening extend therethrough and a second flange through which an opening extends and the second body portion can include a first flange through which an opening and a second flange through which an opening extends. The hinge can include a protrusion that extends from the first body portion, between the first flange and the second flange. The first flange of the second body portion can includes a groove and an arcuate ramp extending therefrom.

The first opening of the first flange of the first body portion can be aligned with the first opening of the first flange of the second body portion and the aperture of the second flange of the first body portion can be aligned with the aperture of the second flange of the second body portion and a fastener can extend through each of the apertures to hingedly couple the first body portion and the second body portion to each other.

The hinge can be slidably fixed to the shaft assembly that can include a shaft, a washer, a spring, a knob and a retaining member. The knob can be delimited at a first end and a second end and can include a body that has a first groove that is spaced from the first end, a second groove that is spaced from the first groove towards the second end, a head that delimits the second end. In an assembled state, the washer can be fixed on the shaft a distance from the first end thereof, the spring can extend over the shaft, the knob can be at least in contact with the shaft and the retaining member can be arranged in the first groove of the knob to secure the knob to the hinge.

In use, the knob can be pulled outward, away from the hinge to release the hinge from a fixed, upright position. Here, the knob can travel along the ramp of the flange until the first and second leg are in a closed position. To extend the legs to a use position, the legs can be hingedly rotated in an opposite direction from the rest position and the shaft assembly can lock the legs in an upright position.

DETAILED DESCRIPTION OF EXAMPLE EMBODIMENTS

Figure 1:
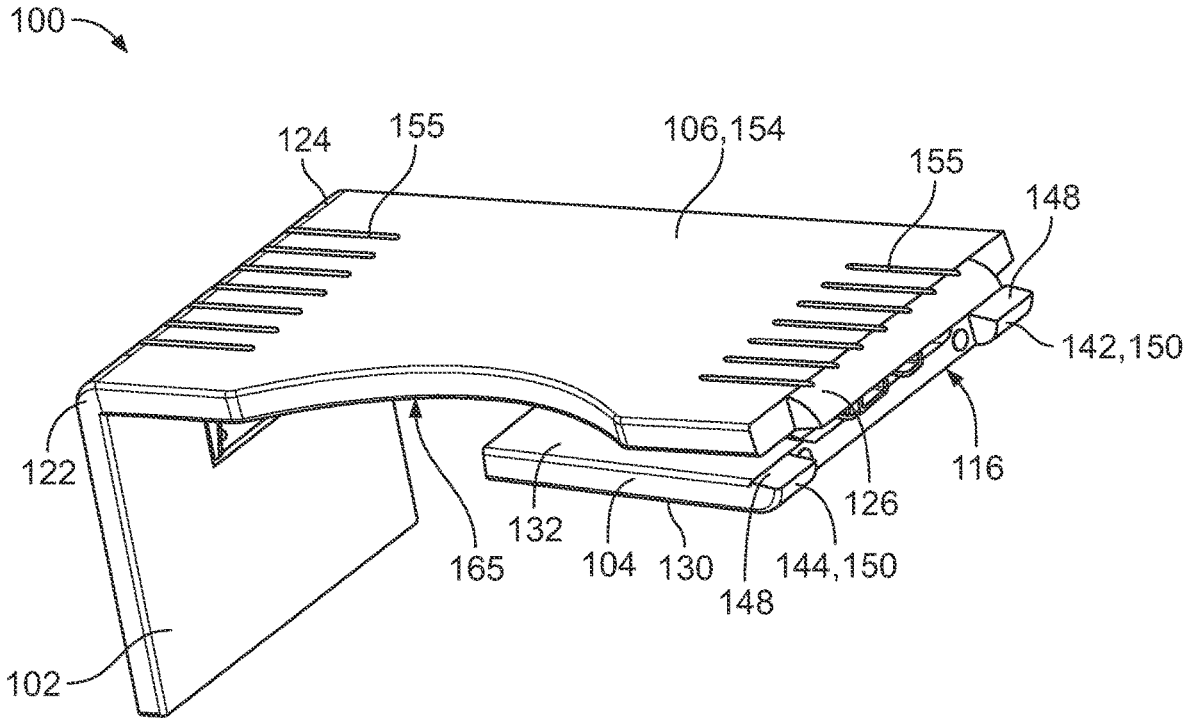
FIG. 1 is top perspective view of a foldable footrest according to an exemplary embodiment of the present disclosure.
Figure 2:
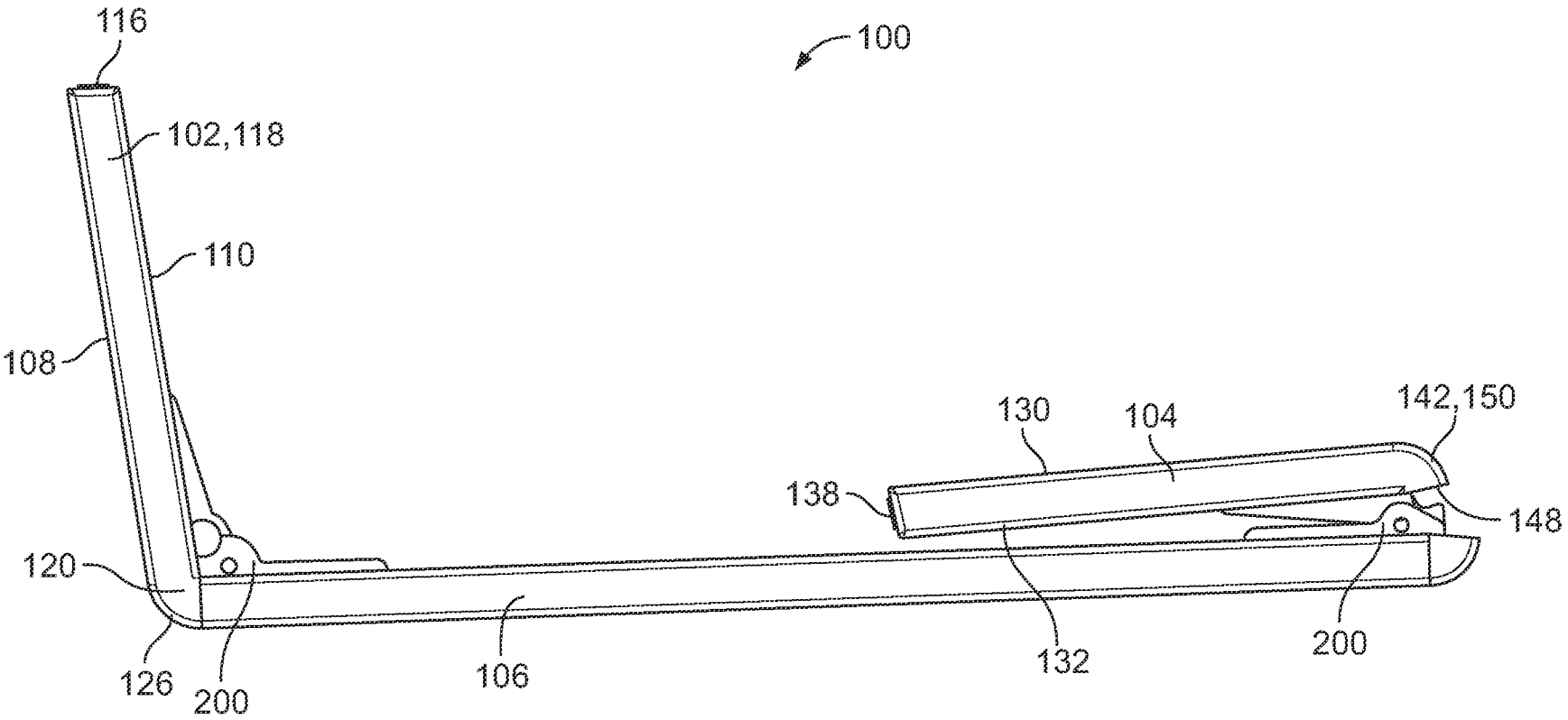
FIG. 2 is a side elevation view of the foldable footrest of FIG. 1.
Figure 3:
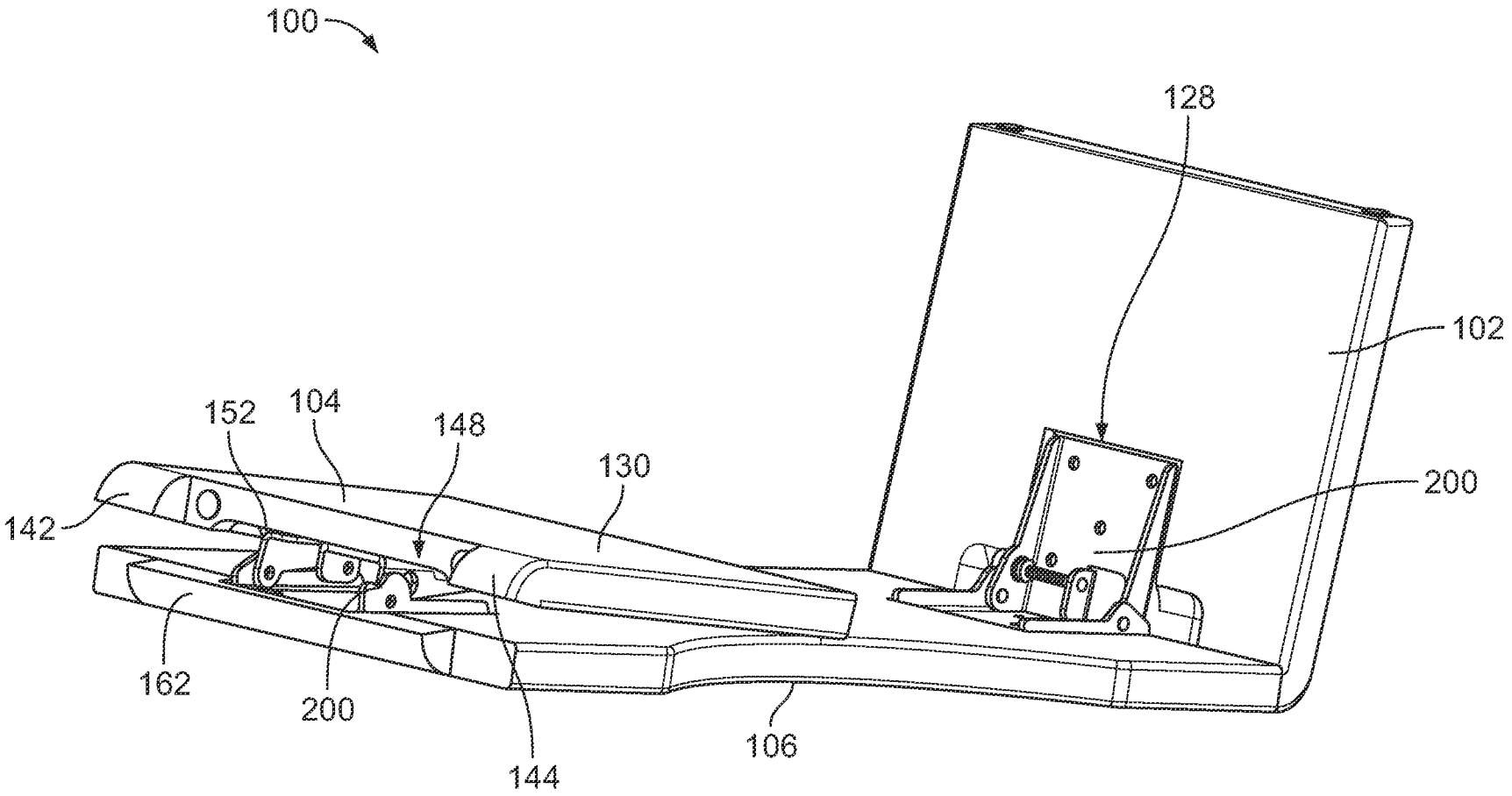
FIG. 3 is a first bottom perspective view of the foldable toilet footrest of FIG. 1.
Figure 4:
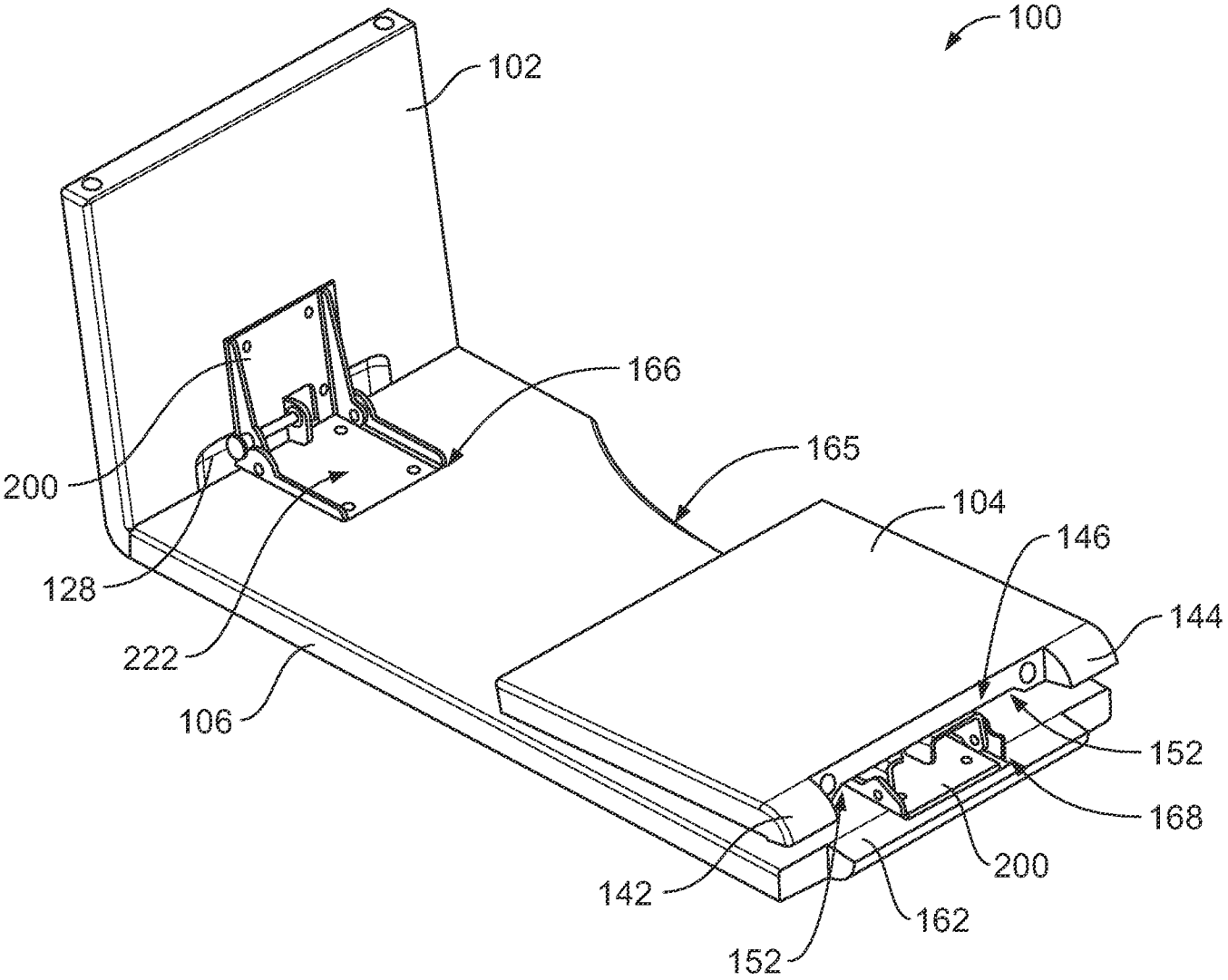
FIG. 4 is a second bottom perspective view of the foldable toilet footrest of FIG. 1.
Figure 5:
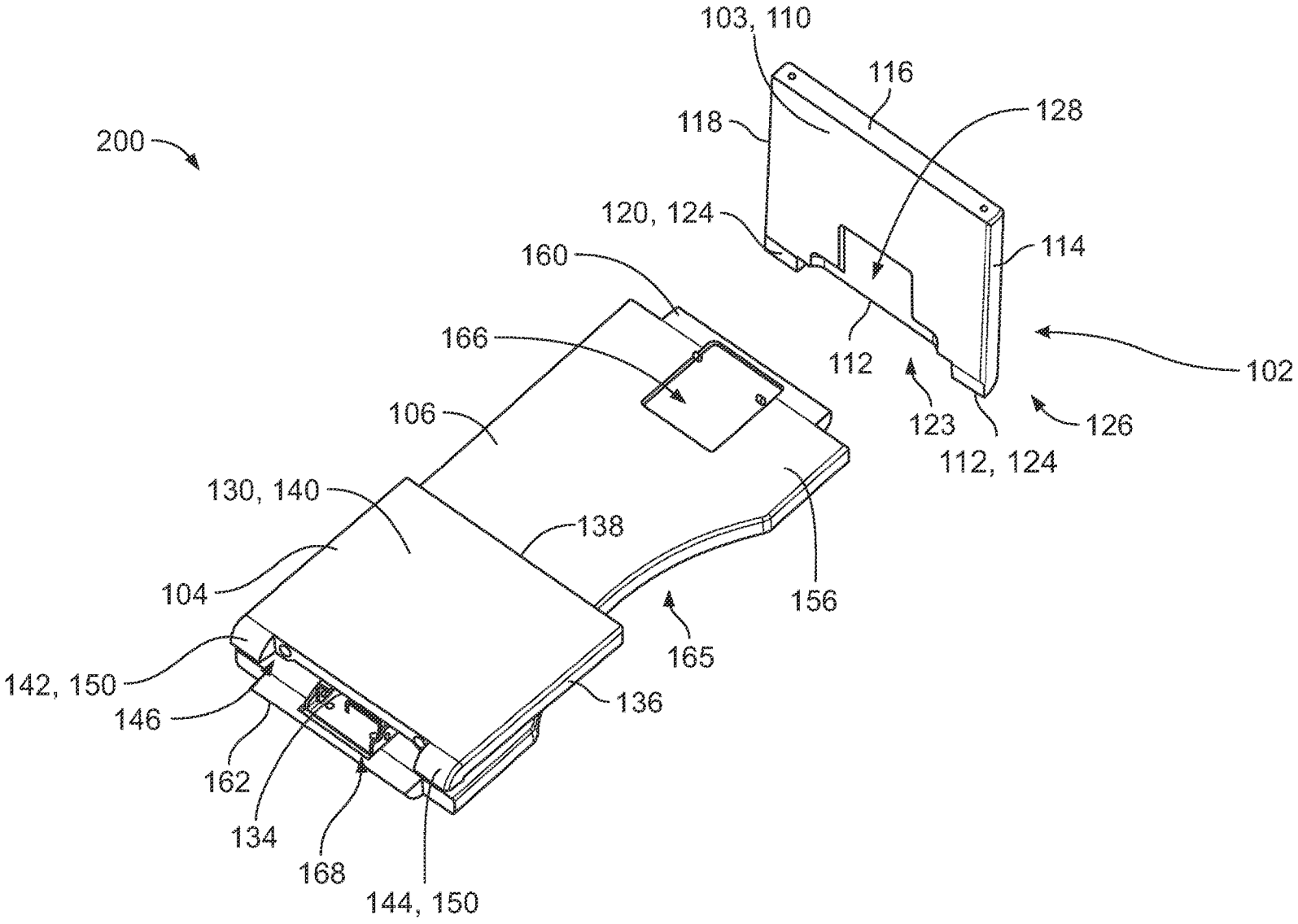
FIG. 5 is a bottom partial assembly perspective view of the foldable toilet footrest of FIG. 1.
Figure 6:
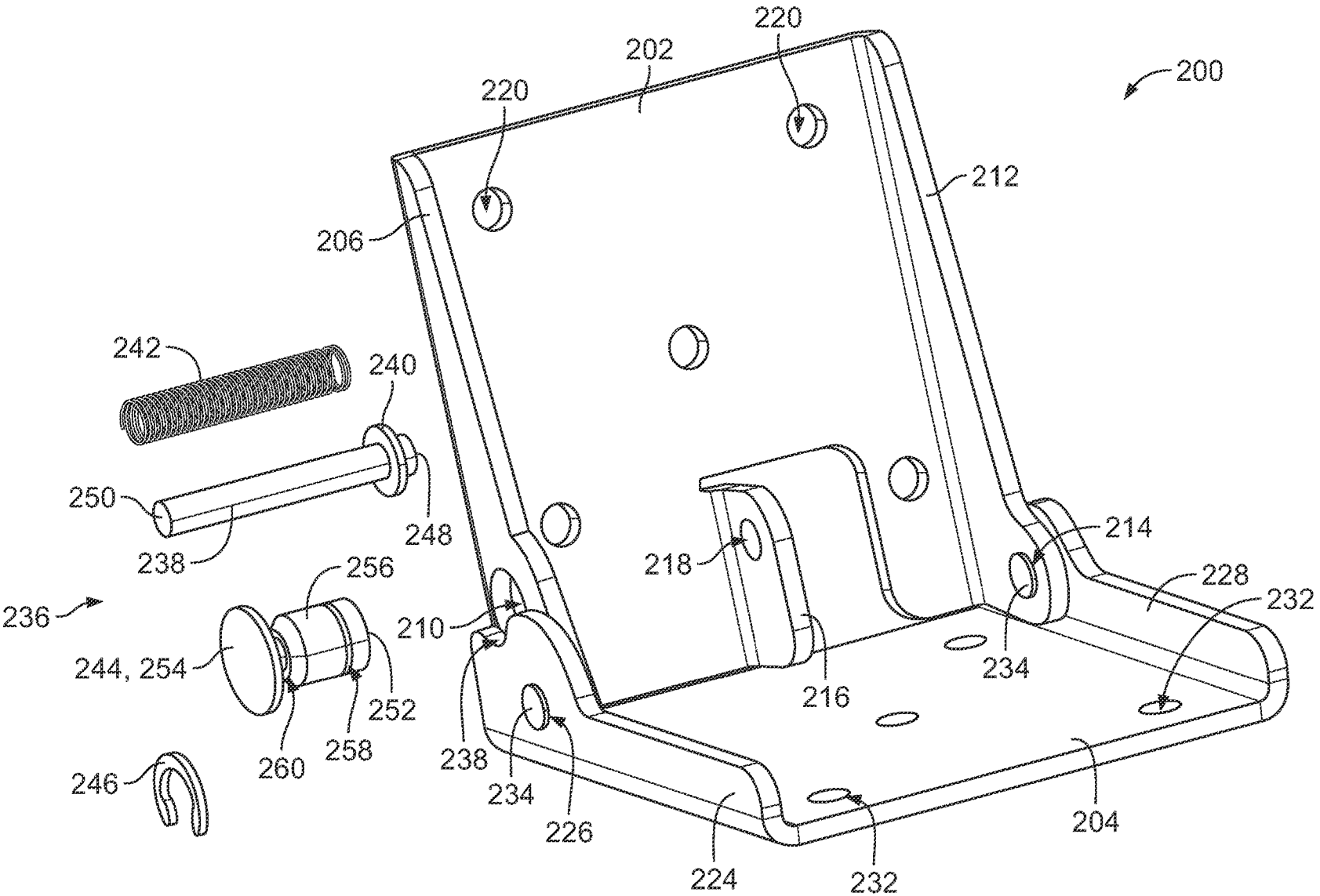
FIG. 6 is a partially exploded perspective view of a hinge of the foldable toilet footrest of FIG. 1 according to an exemplary embodiment of the present disclosure.

The following descriptions depict exemplary embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various different sequences and arrangements while still falling within the scope of the present invention.

The term "coupled" may mean that two or more elements that are in direct physical contact. However, "coupled" may also mean that two or more elements that are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

With reference now to the drawings and in particular FIGS. 1-13, embodiments of a toilet footrest and related features thereof of the present disclosure will be described.

Generally, the foldable footrest described herein comprises a platform with a first leg and a second leg that are coupled thereto by hinges. The hinges can include a releasable locking system that allows the first leg and the second leg by to be fixed in an unfolded use position or a folded non-use position.

FIGS. 1-9 and 14-15 depict an embodiment of a foldable toilet footrest 100 that generally includes a first leg 102 and a second leg 104 that are hingedly coupled a foot platform 106.

The first leg 102 includes a first surface 108 and a second surface 110 that is mirror opposite the first surface 108. The first and second surfaces 108, 110 are delimited by a first sidewall 112, a second sidewall 114, a third sidewall 116 and a fourth sidewall 118. As can be seen, for example in FIG. 5, extending from the first sidewall 112 is a first projection 120 and a second projection 122 that is spaced from the first projection 120. The first projection 120 and the second projection 122 form a first channel 123 therebetween. Both the first projection 120 and the second projection 122 have a first surface 124 that extends from the first surface 108 of the main body 103 and a second surface 126 that extends contiguous and seamlessly from the second surface 122 of the main body 103 of the first leg 102 in a curved manner toward the first surface 124 of each of the first and second projections 120, 122. Also, as can be seen, for example in FIG. 5, the first leg 102 can include a first recess 128 that extends from the second surface 110 toward the first surface 108.

The second leg 104, which is identical to the first leg 102, includes a first surface 130 and a second surface 132 that is mirror opposite the first surface 130. The first and second surfaces 130, 132 are delimited by a first sidewall 134, a second sidewall 136, a third sidewall 138 and a fourth sidewall 140. As can be seen, for example in FIG. 5, extending from the first sidewall 134 is a first projection 142 and a second projection 144 that is spaced from the first projection 142. The first projection 142 and the second projection 144 form a first channel 146 therebetween. Both the first projection 142 and the second projection 144 have a first surface 148 that extends from the first surface 130 of the main body 105 and a second surface 150 that extends contiguous and seamlessly from the second surface 150 of the main body 105 of the second leg 104 in a curved manner toward the first surface 148 of each of the first and second projections 142, 144. Also, as can be seen, for example in FIG. 5, the second leg 104 can include a second recess 152 that extends from the second surface 132 toward the first surface 130.

It is noted that while the recesses 128, 152 are described herein and depicted in various figures of the present disclosure, it is appreciated that the footrest 100 in some embodiments may not include recessed areas.

The footrest platform 106 includes a first surface 154 and a second surface 156 that is mirror opposite the first surface 154. The first surface 154 can include a plurality of grips 155 that can, for example, be grooves that extend from the first surface 154 toward the second surface 156 or projections, such as strips, dots or the like, that have a high coefficient of friction (e.g., silicone, rubber, etc.) that extend from the first surface 154. Extending from a first end 158 of the footrest platform 108 is a first platform projection 160 and extending from a second end 162 of the footrest platform 108, which is mirror opposite the first end 158, is a second platform projection 164. Each of the first platform projection 160 and the second platform projection 164 extend in a curved manner from the first surface 154 toward a second surface 156 thereof. A first recess 166 extends at the first end 158 of the footrest platform 106 from the second surface 156 thereof towards the first surface 154 thereof. The first recess 166 can extend from the main body of the footrest platform 106, at least in part, into the second surface 156 of the first platform projection 160. Similarly, a second recess 168 extends at the second end 162 of the footrest platform 108 from the second surface 156 thereof towards the first surface 154 thereof. The second recess 168 can extend from the main body of the footrest platform, at least in part, into the second surface 156 of the second platform projection 164. Additionally, an arcuate recess 165 is formed in the footrest platform 108 to aid in positioning the footrest platform 108 near a toilet.

The first leg 102, the second leg 104 and the platform 106 can be comprised of a same material such as wood, plastic, metal or a combination thereof. Alternatively, the first leg 102, the second leg 104 and the foot platform 106 can be comprised of different materials. For example, the first leg 102 and the second leg 104 can be comprised of wood while the foot rest 106 can be comprised of a plastic material.

In an assembled state, as will be described subsequently in detail, the first platform projection 160 is rotatably positionable between the first and second projections 120, 122 of the first leg 102 and the second platform projection 164 is rotatably positionable between the first and second projections 142, 144 of the second leg 104 with the first leg 102 and the second leg 104 hingedly coupled to the foot platform 106.

More specifically, the first leg 102 and the second leg 104 are coupled to the foot platform 106 by a hinge 200. While the hinge 200 is shown in the figures as fixing both the first leg 102 to the platform 106 and the second leg 104 to the platform 106, it is noted that the hinge 200 could fix one of the legs 102, 104 to the platform 106 and another hinge, such as a hinge 300, that will be described below and is depicted in FIGS. 10-13.

As illustrated in FIGS. 6-9 and 14-15, the hinge 200 comprises a first body portion 202 and a second body portion 204 that are pivotably coupled to each other. The first body portion 202 can include a first flange 206 through which a first aperture 208 and a second aperture 210 extend and a second flange 212 through which a third aperture 214 extends. As can be seen, for example, in FIG. 6, the first flange 206 can extend from and delimit a first side of the first body portion 202 and the second flange 212 can extend from and delimit a second side of the first body portion 202. A protrusion 216, which can include an opening, or shaft aperture, 218 that extends therethrough, can extend from the first body portion 202, between and in a same direction as the first flange 206 and the second flange 212. The first body portion 202 can further include a plurality of openings 220 through which fasteners 222 (e.g., screws, nail or the like) can extend to fix the first body portion 202 to the first leg 102 and the second leg 104 or the platform 106.

The second body portion 204 can include a first flange 224 through which a first aperture 226 extends and a second flange 228 through which a second aperture 230 extends. As can be seen, for example, in FIG. 6, the first flange 224 can extend from and delimit a first side of the second body portion 204 and the second flange 228 can extend from and delimit a second side of the second body portion 204. As can be seen, for example in FIG. 14, an outer surface of the first flange 224 has a generally arcuate surface 229 with a groove or a notch 227 formed at a rear portion thereof. The second body portion 204 can further include a plurality of openings 232 through which the fasteners 222 (e.g., screws, nail or the like) can extend to fix the second body portion 204 to the first leg 102 and the second leg 104 or the platform 106. That is, when the first body portion 202 is fixed to the first leg 102 or second leg 104, the second body portion 204 is fixed to the platform 106. Conversely, when the second body portion 204 is fixed to the first leg 102 and/or the second leg 104, the first body portion 202 is fixed to the platform 106.

In an assembled state, the first flange 206 and the second flange 212 of the first body portion 202 are configured to interact with first flange 224 and the second flange 228 of the second body portion 204 and vice versa. As can be seen in FIGS. 6-9, the flanges 206, 212 of the first body portion 202 extend between the flanges 224, 228 of the second body portion 204. The first aperture 208 of the first flange 206 of the first body portion 202 is aligned with the first aperture 226 of the first flange 224 of the second body portion 204 and the third aperture 214 of the second flange 212 of the first body portion 202 is aligned with the second aperture 230 of the second flange 228 of the second body portion 204 with a fastener 234 (e.g., pin, rivet, screw, etc.) extending through each of the apertures 208, 214, 226, 230 to hingedly couple the first body portion 202 and the second body portion 204 to each other and thereby allowing the first leg 102 and the second leg 104 to be moved between a folded and unfolded position. The first and second body portions 202, 204 rotate relative to each other along a main axis 272 that passes through the aligned apertures 208, 226, 214, 230.

To lock the first leg 102 and second leg 104 in a folded or an unfolded position, the hinge 200 includes a slidably fixed shaft assembly 236 that interacts with and engages features of the first and second body portion 202, 204 to lock and unlock the hinge coupling of the first and second body portions 202, 204 as will be described below.

The shaft assembly 236 generally includes a shaft 238, a washer 240, a spring 242, a knob 244 and a retaining member 246.

The shaft 238 is delimited at a first end 248 and a second end 250 thereof. The washer 240 extends over the shaft 238 and is coupled or fixed to the shaft 238 a distance from the first end 248 thereof. As can be seen, for example, in FIG. 9, the first end 248 of the shaft 238 can be arranged within the opening 218 of the protrusion 216 of the first body portion 202 of the hinge 200 with the washer 240 contacting the protrusion 216 and delimiting the distance the shaft 238 can extend through the opening 218. In other words, the washer 240 is configured to allow a predetermined length of the first end 248 of the shaft 238 to extend through the opening 218 of the protrusion 216. The spring 242 can be arranged over the shaft 238 to substantially encompass the shaft 238 between the protrusion 216 and flange 206. The spring 242 can, for example, be a compression spring. Once the spring 242 is arranged on the shaft 238, the knob 244 can be arranged to extend through the second aperture 210 of the first flange 206 of the first body portion 202. The shaft 238 extends into an axial opening 245 within the knob 244 (See FIG. 15)

Figure 7:
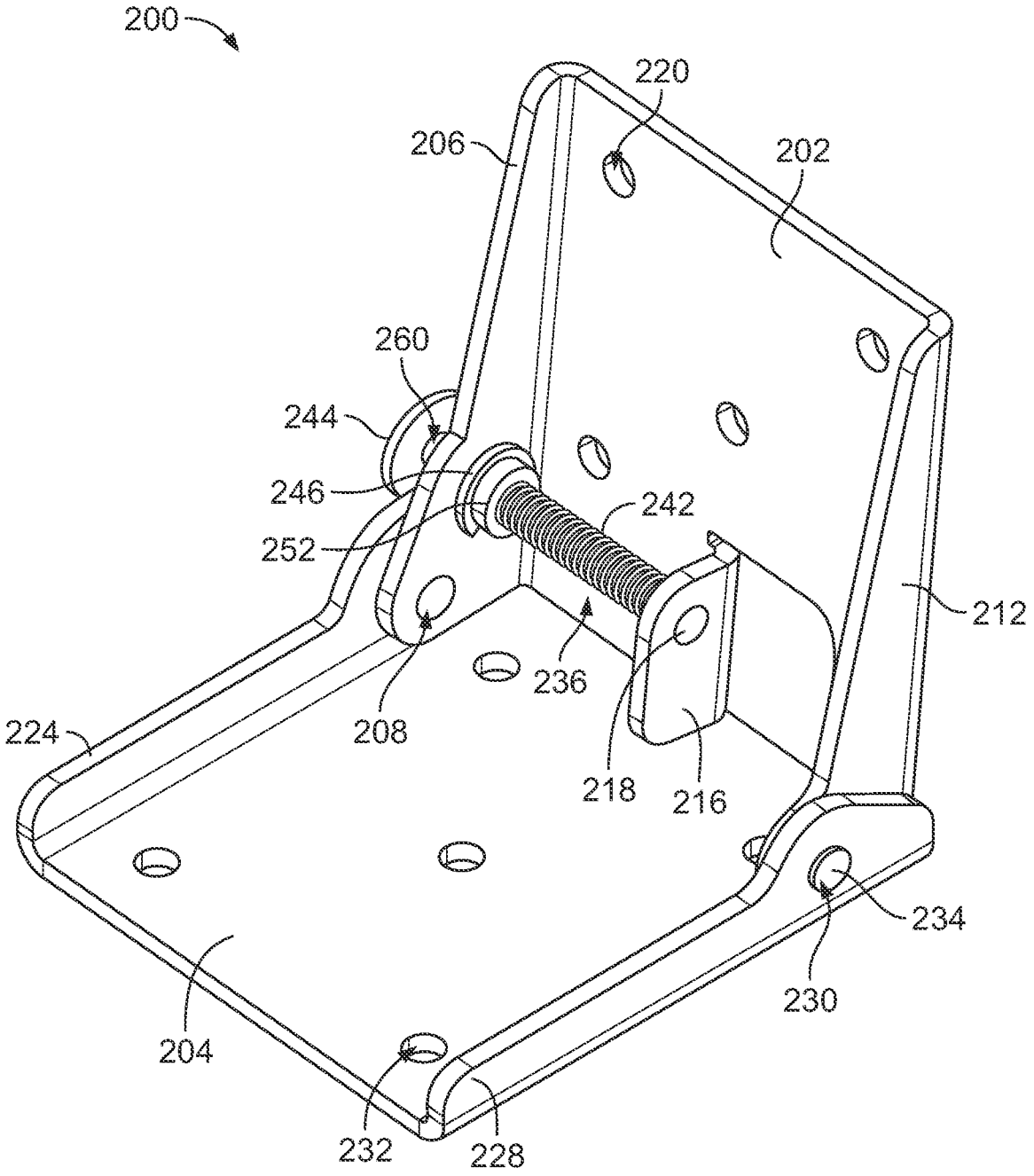
FIG. 7 is another perspective view of the hinge of FIG. 6 in an assembled state.
Figure 8:
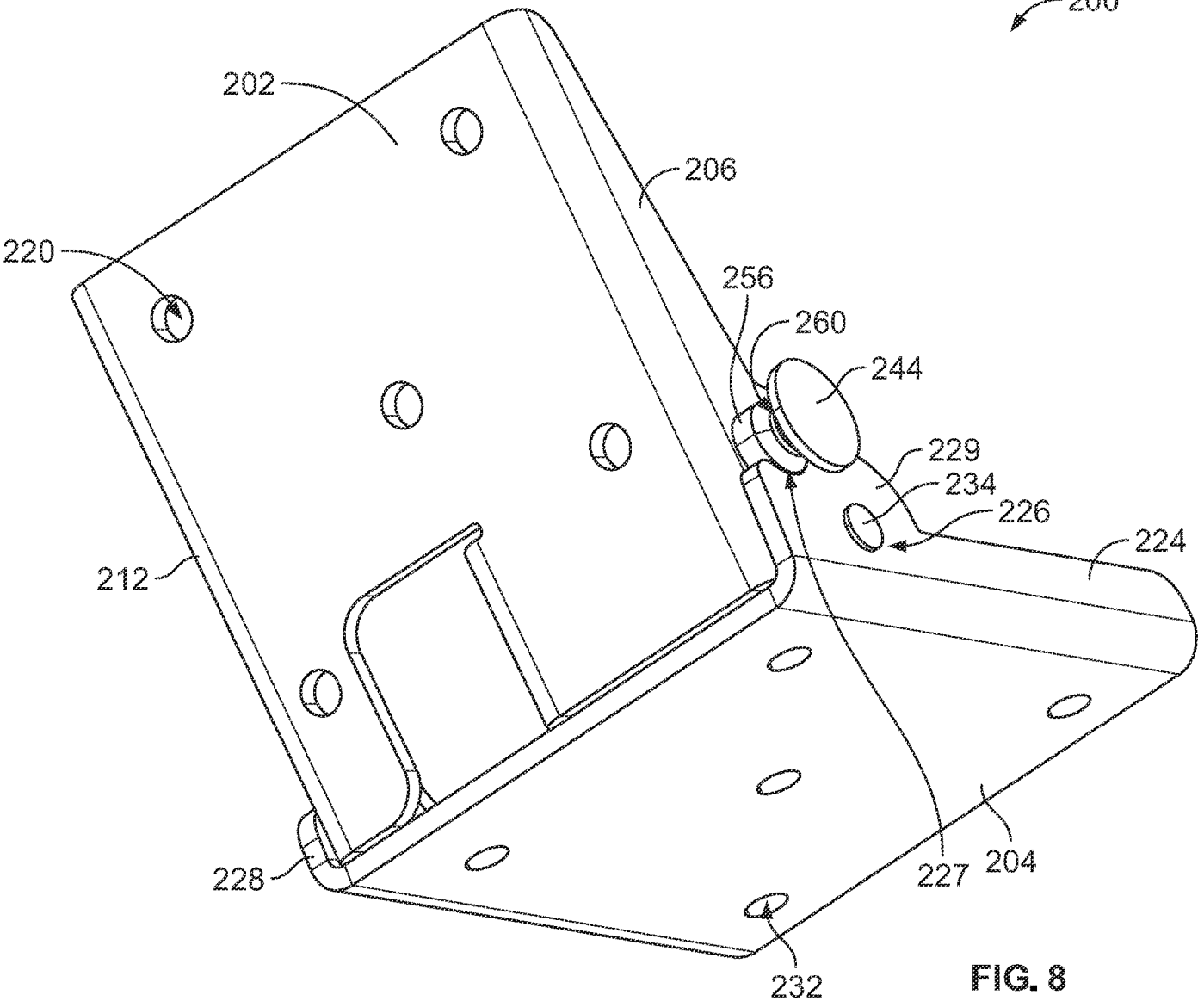
FIG. 8 is a bottom perspective view of the hinge of FIG. 6 in an assembled state.
Figure 9:
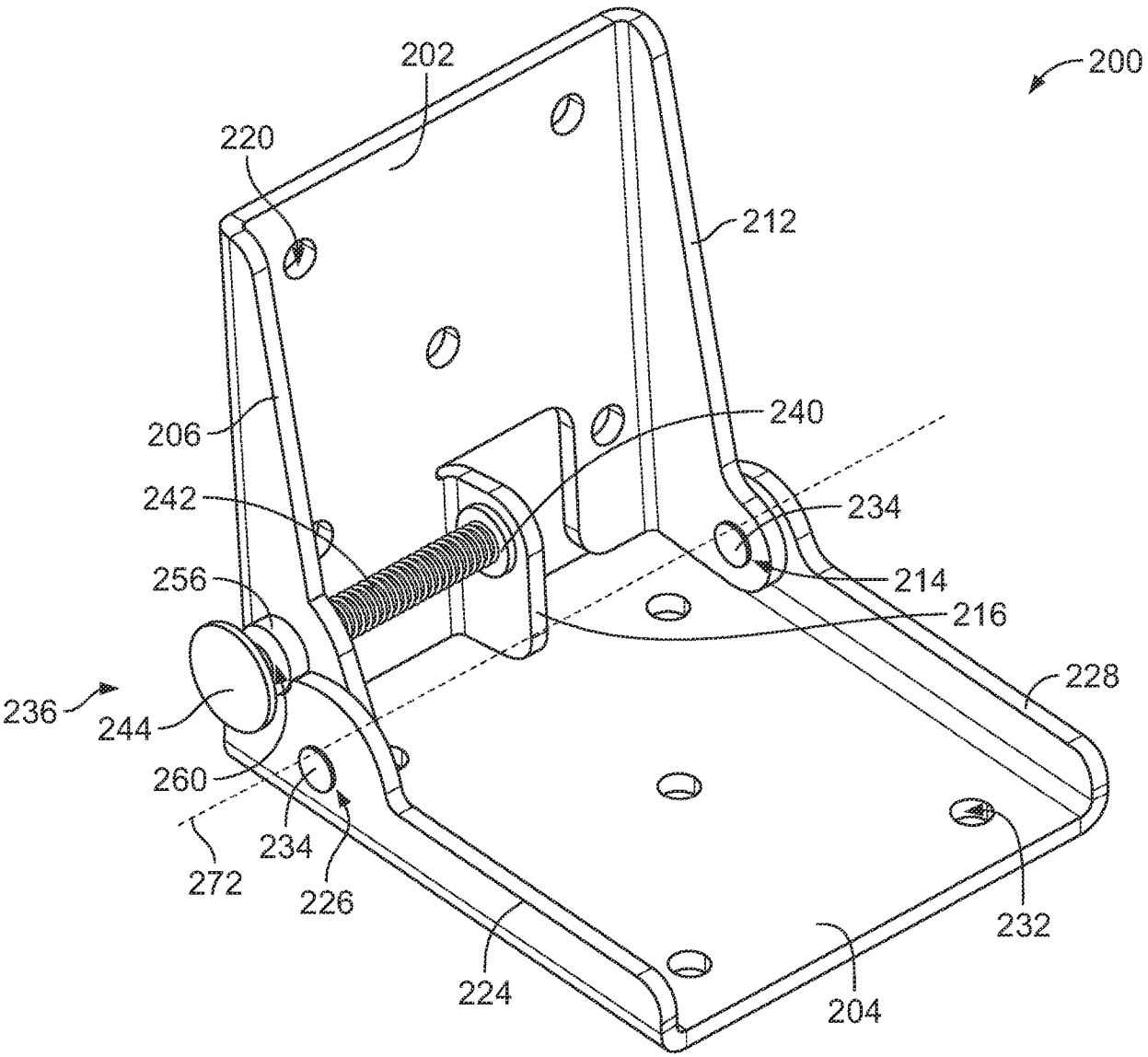
FIG. 9 is a top perspective view of the hinge of FIG. 6 in an assembled state.
Figure 10:
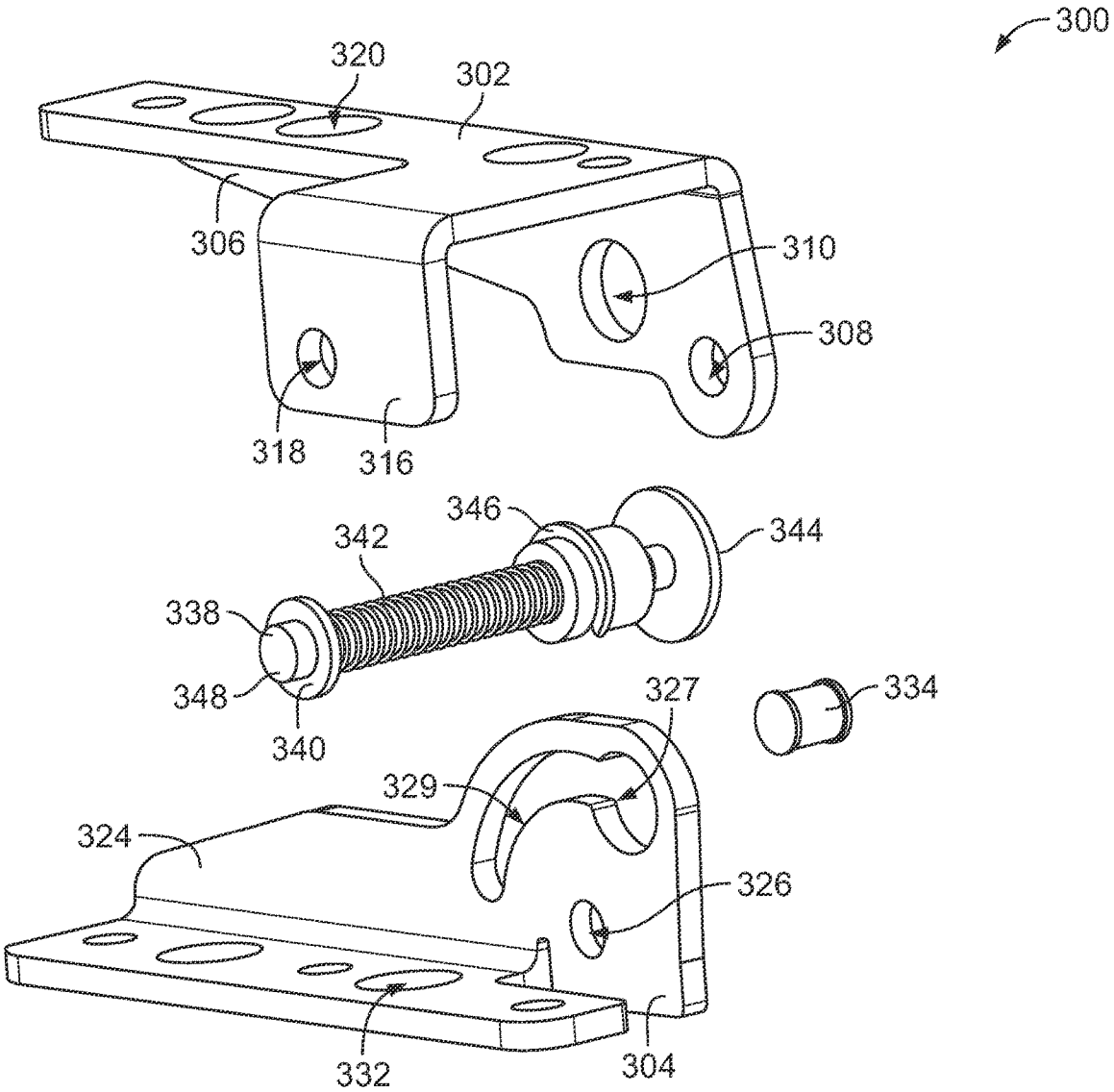
FIG. 10 is an exploded view of another hinge of the foldable toilet footrest of FIG. 1 accordingly to an exemplary embodiment of the present disclosure.

As can be seen in FIGS. 6-9 and 15, the knob 244 is delimited at a first end 252 and a second end 254 and can include a body 256 that has a first groove 258 that is spaced from the first end 252, a second groove or neck 260 that is spaced from the first groove 258 towards the second end 254, a head 262 that delimits the second end 254 and an opening 245 extending from the first end 252 towards the second end 254. When the knob 244 is inserted through the second aperture 210 of the first flange 206 of the first body portion 202, the knob 244 can receive the second end 248 of the shaft 238 at least partially therein within the opening 245. The retaining member 246, which can be, for example, a clip, retaining washer or the like, as shown in FIG. 7, extends, in an assembled state, within the first groove 258 of the shaft 238 to prevent the shaft 238, spring 242 and knob 244 from being separated from each other.

Figure 15:
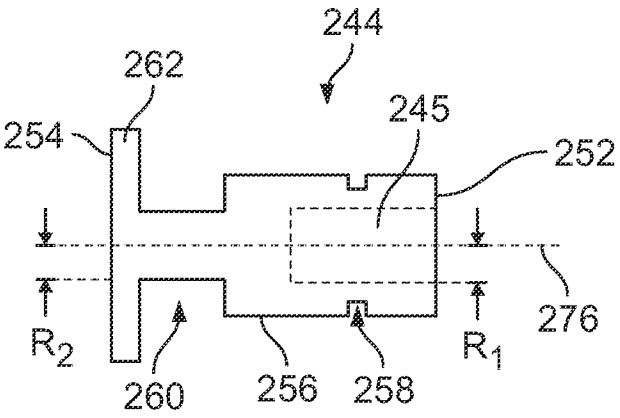
FIG. 15 is a side view of an exemplary embodiment of the knob portion of the fixed shaft assembly of FIGS. 6-9.
Figure 14:
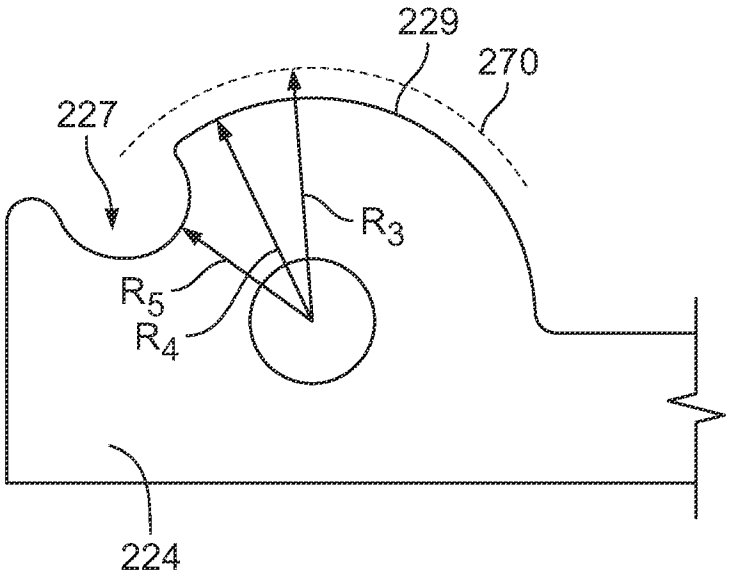
FIG. 14 is a side view of a portion of the hinge of FIGS. 6-9.

With reference to FIGS. 14 and 15, the main body portion 256 of the knob can be generally cylindrical with a radius of R1 relative to a central axis 276 of the knob 244. The neck portion 260 of the knob 244 can also be generally cylindrical with a radius of R2 relative to the central axis 276, and where R2<R1.

When the hinge 200 is moved from an open to a closed position, a central axis 276 of the knob 244 moves along an arcuate path 270 defined by the main axis 272 of the hinge 200 and having a radius of R3. Arcuate surface 229 a radius of R4 relative to the main axis 272.

Notch 227 can be configured so it has a radial distance R5 from the central axis, where R5 is less than or equal to the radius R3 of path 270 minus the radius R1 of the main body portion 256 of the knob.

When the hinge 200 is open and in a locked position, the fixed shaft assembly 236 is in a first lock position wherein the knob 244 is urged outward on the shaft 238 by spring 242 until the retaining member 246 contacts the inner side of the flange 206 of the first body portion 202 and the main body portion 256 of the knob is in alignment with the first flange 224 of the second body portion 204 and is captured within the notch 227.

The radius R4 of the arcuate surface 229 adjacent the notch 227 is less than or equal to radius R3 of path 270 minus the radius R2 of the neck portion 260 of the knob 244 but greater than radius R3 minus the radius R1 of the main body portion 256 of the knob. As a result, when the fixed shaft assembly 236 is in its first locking position, the hinge 200 cannot be rotated to move the main body portion 256 of the knob out of the notch 227 and along arcuate path 270 because the main body portion 256 is too large.

The length of the shaft 238 and depth of opening 245 in the knob 244 are configured so that the knob 244 can be pushed inwards towards the first flange 224 of the second body portion 204 moving the knob 244 from the first lock position to a second unlock position where the neck portion 260 of the knob 244 is in alignment with the first flange 224 of the second body portion 204. Because of the narrower radius of the neck portion 260 relative to the main body portion 256 of knob 244, the knob 244 is not captured within the notch 227 and the hinge 200 can be rotated with the neck portion 260 moving along the arcuate path 270 above the arcuate surface 229.

The knob 244 can be generally cylindrical. In alternative embodiments, knob 244 can have other shapes, such as an oval or polygonal cross-sections as long as the relative sizes of the main body portion 256, neck 260 and dimensions and placements of the notch 227 and arcuate surface 229 are selected to allow the knob to lock and unlock the hinge as described herein.

While one notch 227 is shown and that operates with the shaft assembly 236 to retain the hinge in an open position, a second notch could also be added to allow the hinge to be locked in its closed position.

FIGS. 10-13 and 16-17 depict an embodiment of another hinge 300 that can be used in place of the hinge 200 discussed above but which is more compact. As illustrated hinge 300 comprises a first body portion 302 and a second body portion 304 that are pivotably coupled to each other. The first body portion 302 can include a first flange 306 through which a first aperture 308 and a second aperture 310 extend. As can be seen, for example, in FIG. 10, the first flange 306 can extend from and delimit a first side of the first body portion 202. The first body portion 302 can have a second flange 316 extending in the same direction as the first flange 306. Second flange 316 has an opening, or shaft aperture, 318 that extends therethrough and which is in axial alignment with the aperture 310 in the first flange 306. The first body portion 202 can further include a plurality of openings 320 through which fasteners 222 (e.g., screws, nail or the like) can extend to fix the first body portion 202 to the first leg 102 and the second leg 104 or the platform 106.

The second body portion 304 can include a flange 324 through which a first aperture 326 extends. Flange 324 further has an arcuate slot 329 with a larger aperture 327 formed at a rear portion thereof. These features are discussed further below with respect to FIG. 16. The second body portion 304 can further include a plurality of openings 332 through which the fasteners 222 (e.g., screws, nail or the like) can extend to fix the second body portion 204 to the first leg 102 and the second leg 104 or the platform 106. That is, when the first body portion 302 is fixed to the first leg 102 or second leg 104, the second body portion 304 is fixed to the platform 106. Conversely, when the second body portion 304 is fixed to the first leg 102 and/or the second leg 104, the first body portion 302 is fixed to the platform 106.

In an assembled state, the first flange 306 of the first body portion 302 is configured to interact with first flange 324 of the second body portion 304 and vice versa. As can be seen in FIGS. 10-13, the first aperture 308 of the first flange 306 of the first body portion 302 is aligned with the first aperture 326 of the flange 324 of the second body portion 304 with a fastener 334 (e.g., pin, rivet, screw, etc.) extending through each of the apertures 308, 326 to hingedly couple the first body portion 302 and the second body portion 304 to each other and thereby allowing the first leg 102 and the second leg 104 to be moved between a folded and unfolded position. In this coupled position, the aperture 310 opposed to aperture 237 or arcuate slot 329 depending on the position of the first and second body portions 302, 304 relative to each other. The first and second body portions 302, 304 rotate relative to each other along a main axis 372 that passes through the aligned apertures 308 and 326.

To lock the first leg 102 and second leg 104 in a folded or an unfolded position, the hinge 300 includes a slidably fixed shaft assembly 336 that interacts with and engages features of the first and second body portion 302, 304 to lock and unlock the hinge coupling of the first and second body portions 302, 304 as will be described below.

The shaft assembly 336 generally includes a shaft 338, a washer 340, a spring 342, a knob 344 and a retaining member 346.

The shaft 338 is delimited at a first end 348 and a second end 350 thereof. The washer 340 extends over the shaft 338 and is coupled or fixed to the shaft 338 a distance from the first end 348 thereof. As can be seen, for example, in FIGS. 12 and 13, the first end 348 of the shaft 338 can be arranged within the opening 318 of the second flange 316 of first body portion 302 of the hinge 300 with the washer 340 contacting the flange 316 and delimiting the distance the shaft 338 can extend through the opening 218. In other words, the washer 340 is configured to allow a predetermined length of the first end 348 of the shaft 338 to extend through the opening 318 of the flange 316. The spring 342 can be arranged over the shaft 338 to substantially encompass the shaft 338 between the flange 316 and flange 306. The spring 342 can, for example, be a compression spring. Once the spring 342 is arranged on the shaft 338, the knob 344 can be arranged to extend through the second aperture 310 of the first flange 306 of the first body portion 202. The shaft 338 extends into an axial opening 345 within the knob 344. (See FIG. 17)

Figure 11:
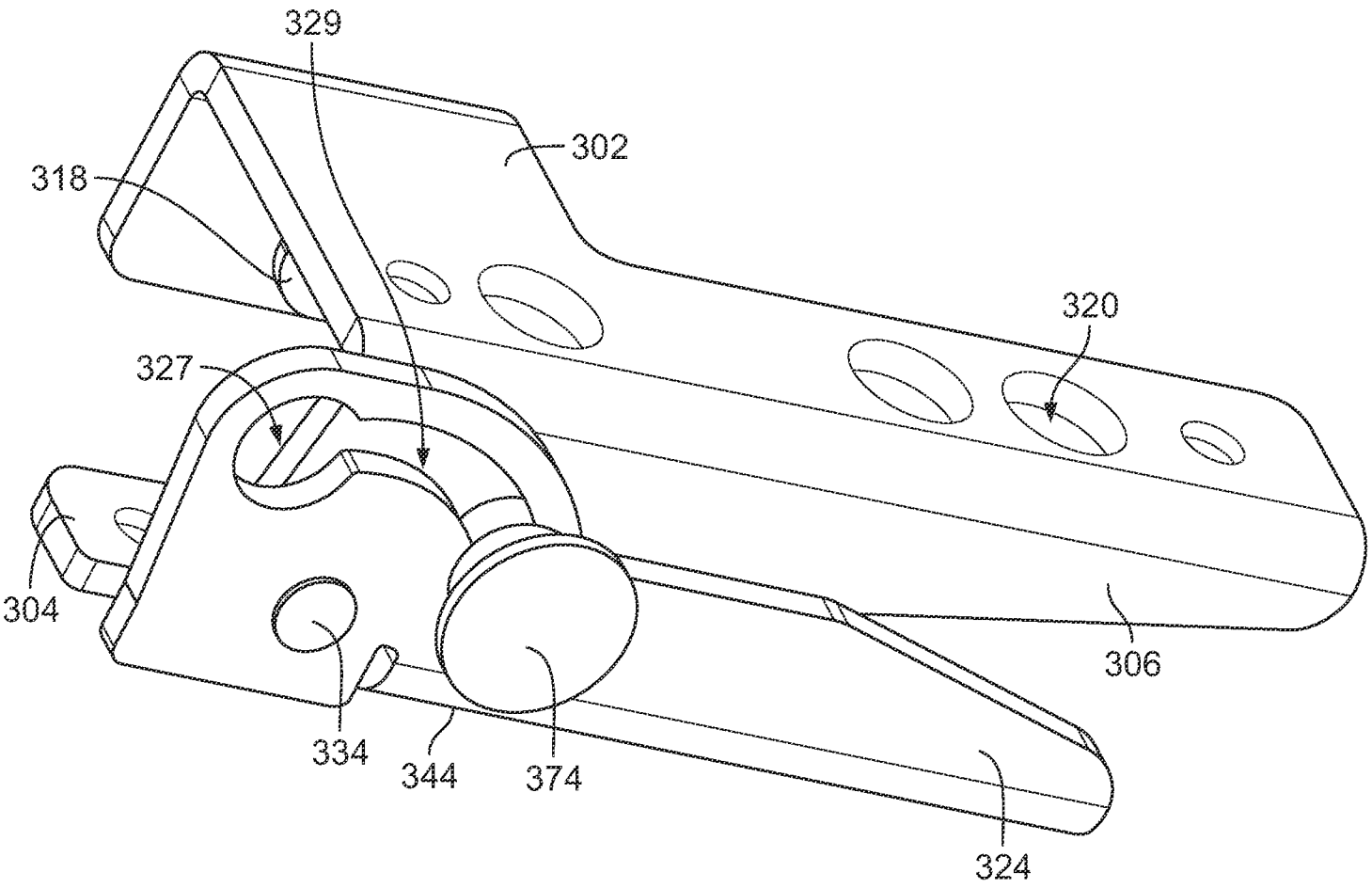
FIG. 11 is a first perspective view of the hinge of FIG. 10.
Figure 12:
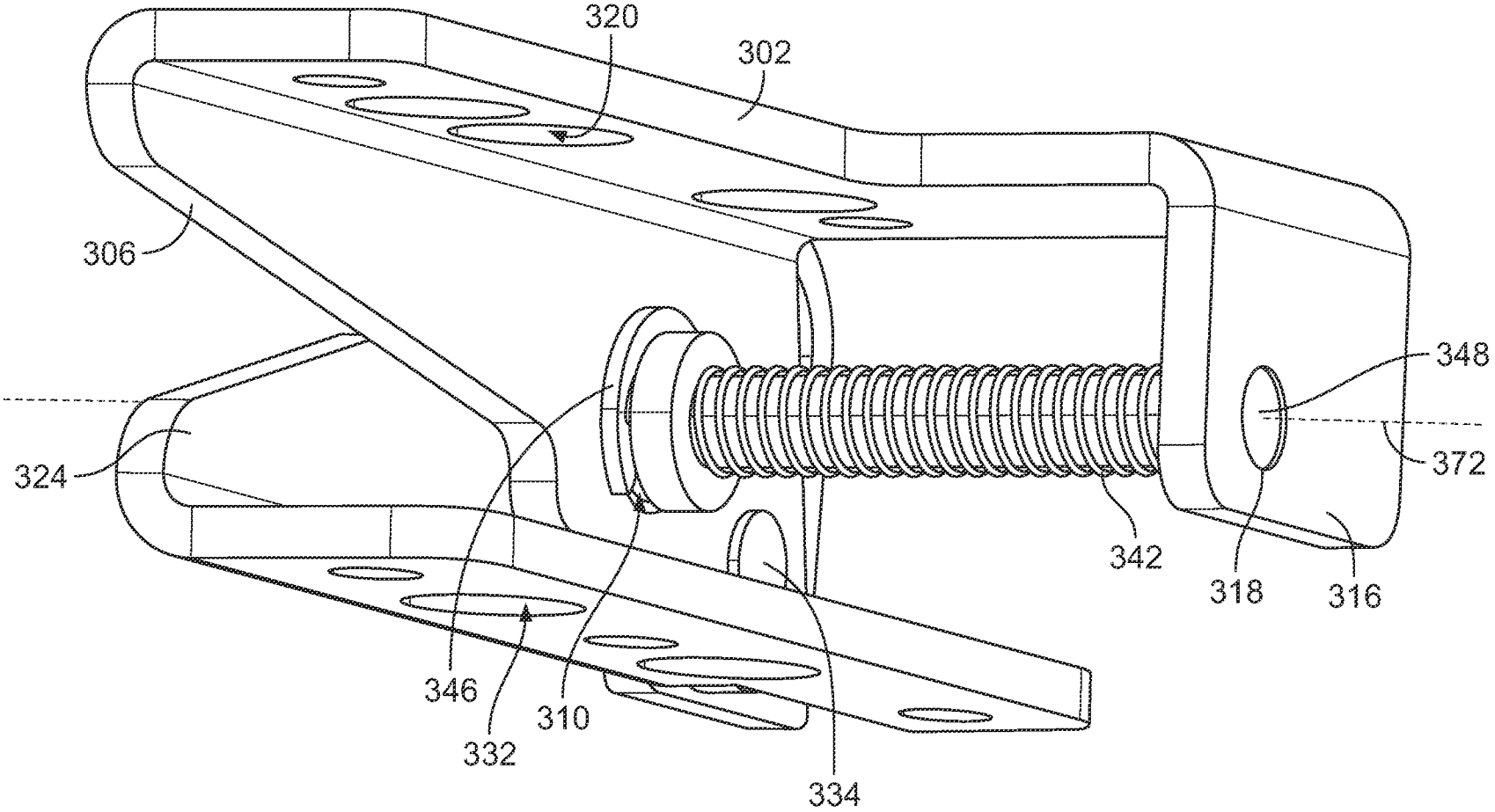
FIG. 12 is a second perspective view of the hinge of FIG. 10.
Figure 13:
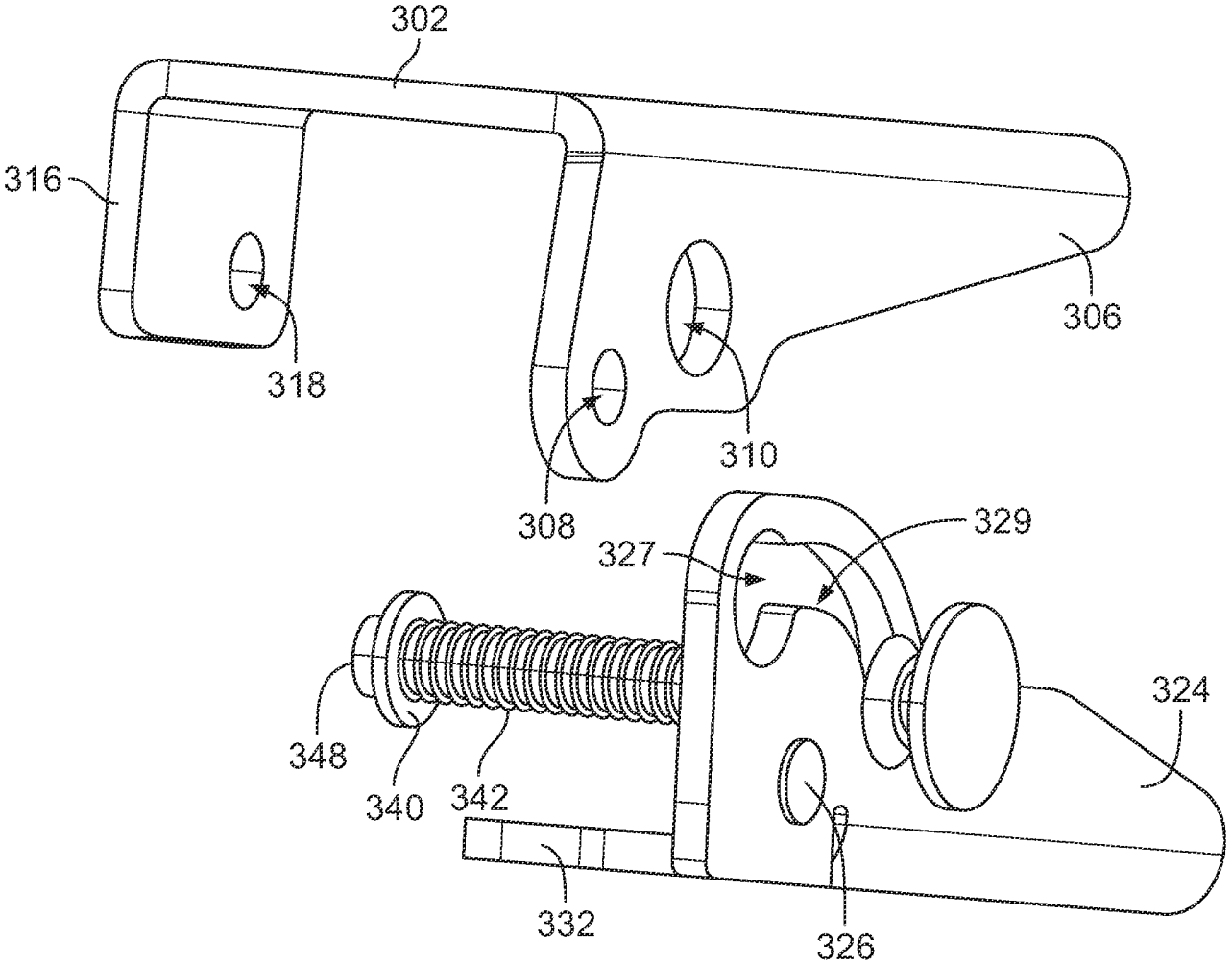
FIG. 13 is another exploded perspective view of the hinge of FIG. 10.

As can be seen in FIGS. 10-13 and 17, the knob 344 is delimited at a first end 352 and a second end 354 and can include a body 356 that has a first groove 358 that is spaced from the first end 352, a second groove or neck 360 that is spaced from the first groove 358 towards the second end 354, a head 362 that delimits the second end 354 and an opening 345 extending from the first end 352 towards the second end 354. When the knob 344 is inserted through the second aperture 310 of the first flange 306 of the first body portion 302, the knob 344 can receive the second end 348 of the shaft 338 at least partially therein within the opening 345. The retraining member 346, which can be, for example, a clip, retaining washer or the like, as shown in FIG. 11, extends, in an assembled state, within the first groove 358 of the shaft 338 to prevent the shaft 338, spring 342 and knob 344 from being separated from each other.

Figure 17:
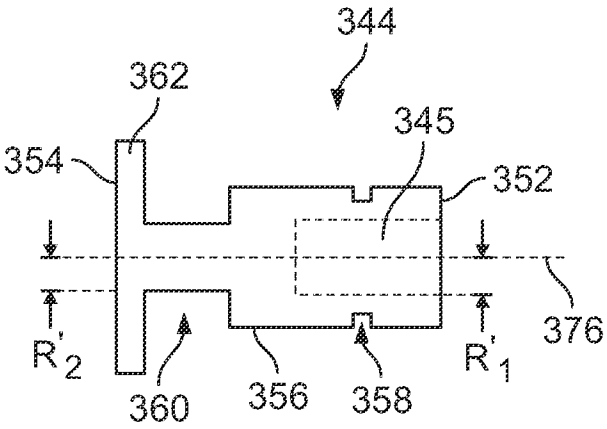
FIG. 17 is a side view of an exemplary embodiment of the knob portion of the fixed shaft assembly of FIGS. 10-13.
Figure 16:
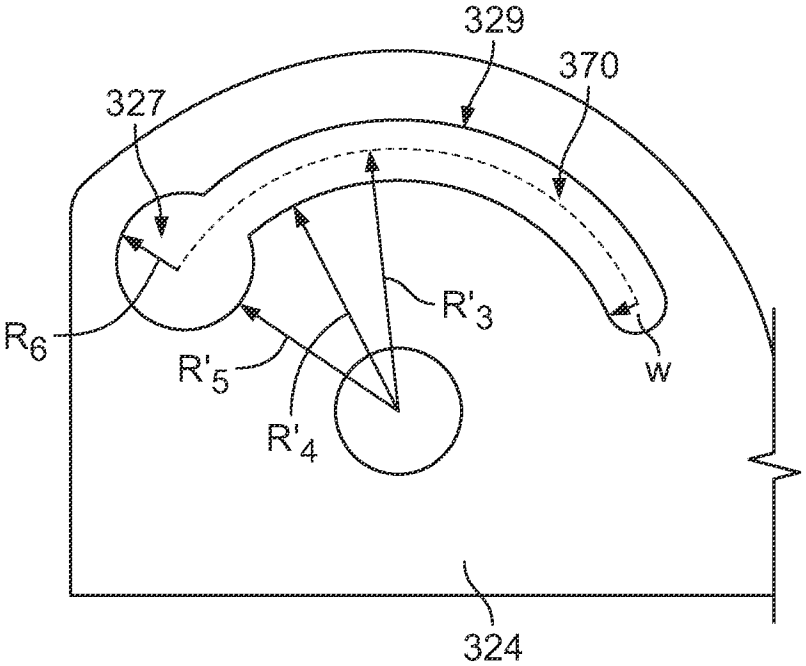
FIG. 16 is a side view of a portion of the hinge of FIGS. 10-13.

With reference to FIG. 17, the main body portion 356 of the knob can be generally cylindrical with a radius of R1' relative to a central axis 376 of the knob 344. The neck portion 360 of the knob 344 can also be generally cylindrical with a radius of R2' relative to the central axis 376, and where R2'<R1'.

When the hinge 300 is moved from an open to a closed position, a central axis 376 of the knob 344 moves along an arcuate path 370 defined by the main axis 372 of the hinge 300 and having a radius of R3'. The arcuate slot 329 has a width 2*W, where W is greater than or equal to R2', but less than R1' and where the slot 329 has an inner edge with a radius of R4' relative to the main axis 272.

Aperture 327 can be circular with a radius of R6 and a center that lies along arcuate path 370. The radius R6 of aperture 327 is greater than or equal to the radius R1' of the main body portion 356 of the knob.

When the hinge 300 is open and in a locked position, the fixed shaft assembly 336 is in a first lock position wherein the knob 344 is urged outward on the shaft 338 by spring 342 until the retaining member 346 contacts the inner side of the flange 306 of the first body portion 302 and the main body portion 356 of the knob is in alignment with the first flange 324 of the second body portion 304 and is within the aperture 327.

Because the radius R1' of the main body portion 356 of the knob 344 is greater than W of the slot 329, when the fixed shaft assembly 236 is in its first locking position, the hinge 300 cannot be rotated to move the main body portion 356 of the knob out of the aperture 327 and into the slot 329.

The length of the shaft 338 and depth of opening 345 in the knob 344 are configured so that the knob 344 can be pushed inwards towards the first flange 324 of the second body portion 304 moving the knob 344 from the first lock position to a second unlock position where the neck portion 360 of the knob 344 is in alignment with the flange 324 of the second body portion 304. The radius R2' of the neck portion 360 is less than W and so the knob 344 can be moved into the slot 329, allowing the hinge 300 to be rotated with the neck portion 360 moving within the slot 329.

The knob 344 can be generally cylindrical. In alternative embodiments, knob 344 can have other shapes, such as an oval or polygonal cross-sections as long as the relative sizes of the main body portion 356, neck 360 and dimensions of the aperture 327 and slot 329 are selected to allow the knob to lock and unlock the hinge as described herein.

While one aperture 327 is shown and that operates with the shaft assembly 336 to retain the hinge in an open position, a second aperture could also be added at the other end of the slot 329 to allow the hinge to be locked in its closed position.

Although this invention has been disclosed in the context of certain embodiments and examples, it will be understood by those skilled in the art that the invention extends beyond the specifically disclosed embodiments to other alternative embodiments and/or uses of the invention and obvious modifications and equivalents thereof. It is to be understood that the phraseology or terminology employed herein is for the purpose of description and not of limitation. In addition, while several variations of the embodiments of the invention have been shown and described in detail, other modifications, which are within the scope of this invention, including, but not limited to, the substitutions of equivalent features, materials, or parts, will be readily apparent to those of skill in the art based upon this disclosure without departing from the spirit and scope of the invention.

What is claimed is:

1. A footrest, comprising:

a platform;

a first leg;

a second leg;

a first hinge fixed to the platform and the first leg to hingedly couple the first leg and platform to each other and allow for rotation of the first leg with respect to the platform between a fixed extended position and a fixed collapsed position; and a second hinge fixed to the platform and the second leg to hingedly couple the second leg and platform to each other and allow for rotation of the second leg with respect to the platform between a fixed extended position and a fixed collapsed position, wherein at least one of the first hinge and the second hinge includes a first body portion and a second body portion that are pivotably fixed to each other, the first body portion includes a first flange through which an opening extends and a second flange through which an opening extends and the second body portion includes a first flange through which an opening extends and a second flange through which an opening extends.

2. The footrest of claim 1, wherein the first leg and the second leg each include a first projection and a second projection that is spaced from the first projection that extend from a first end of each of the first leg and the second leg.

3. The footrest of claim 2, wherein the platform includes a first projection extending from a first end thereof and a second projection extending from a second end thereof.

4. The footrest of claim 3, wherein, in an assembled state, the first projection of the platform extends between the first projection and the second projection of the first leg and the second projection of the platform extends between the first projection and the second projection of the second leg.

5. The footrest of claim 1, wherein the hinge includes a protrusion that extends from the first body portion, between the first flange and the second flange.

6. The footrest of claim 1, wherein the first flange of the second body portion includes a groove and an arcuate ramp extending therefrom.

7. The footrest of claim 1, wherein the first opening of the first flange of the first body portion is aligned with the first opening of the first flange of the second body portion and the aperture of the second flange of the first body portion is aligned with the aperture of the second flange of the second body portion and a fastener extends through each of the apertures to hingedly couple the first body portion and the second body portion to each other.

8. The footrest of claim 1, wherein the hinge includes a slidably fixed shaft assembly that includes a shaft, a washer, a spring, a knob and a retaining member.

9. The footrest of claim 8, wherein the knob is delimited at a first end and a second end and can include a body that has a first groove that is spaced from the first end, a second groove that is spaced from the first groove towards the second end, a head that delimits the second end.

10. The footrest of claim 9, wherein, in an assembled state, the washer is fixed on the shaft a distance from the first end thereof, the spring extends over the shaft, the knob is at least in contact with the shaft and the retaining member is arranged in the first groove of the knob to secure the knob to the hinge.

* * * * *